US010213027B2

(12) United States Patent
Lo

(10) Patent No.: US 10,213,027 B2
(45) Date of Patent: Feb. 26, 2019

(54) FOLDABLE BED

(71) Applicant: Chiu-Hsiang Lo, Taichung (TW)

(72) Inventor: Chiu-Hsiang Lo, Taichung (TW)

( * ) Notice: Subject to any disclaimer, the term of this patent is extended or adjusted under 35 U.S.C. 154(b) by 330 days.

(21) Appl. No.: 15/338,467

(22) Filed: Oct. 31, 2016

(65) Prior Publication Data

US 2018/0116413 A1 May 3, 2018

(51) Int. Cl.
*A47C 19/12* (2006.01)
*A47C 19/02* (2006.01)
*A47C 17/82* (2006.01)

(52) U.S. Cl.
CPC ..... *A47C 19/122* (2013.01); *A47C 17/82* (2013.01); *A47C 19/025* (2013.01)

(58) Field of Classification Search
CPC ..... A47C 19/12
USPC ..... 5/174, 176.1, 201–202, 285, 114, 116
See application file for complete search history.

(56) References Cited

U.S. PATENT DOCUMENTS 6,076,210 A * 6/2000 Wu ..... A47C 19/122 5/174
8,407,837 B1 * 4/2013 Huang ..... A61G 7/002 5/116
9,009,896 B2 * 4/2015 Suh ..... A47C 19/122 5/618

* cited by examiner

*Primary Examiner* — Fredrick C Conley

(57) ABSTRACT

A foldable bed includes a first frame and a second frame. The first frame has a first board put thereon. A first connector is connected to the front end of the first frame and has a first pin hole and a first aperture which is located below the first pin hole. The second frame has a second board put thereon. A second connector is connected to the rear end of the second frame and has a second pin hole and a second aperture which is located below the first pin hole. A pivot extends through the first and second apertures to pivotably connect the first frame to the second frame. When the first and second frames are extended. A pin extends through the first and second pin holes.

17 Claims, 6 Drawing Sheets

FOLDABLE BED

BACKGROUND OF THE INVENTION

1. Fields of the Invention

The present invention relates to a foldable bed, and more particularly, to a foldable bed having a first frame and a second frame which is pivotably connected to the first frame so as to fold the bed.

2. Descriptions of Related Art

The conventional foldable beds generally comprise two frames which are pivotably connected to each other, a board is put on each of the two frames to form a bed. The two frames are foldable relative to each other to reduce the space for storage and transportation. One of the pivotal structure between the two frames includes a shaft which extends through lugs on each of the two frames. The other pivotal structure includes a connection plate which extends through two pivotal members not sharing a common axis so as to connect the two frames together. In order not to be pivoted in reverse direction when the bed is fully extended, a securing sleeves are used to secure the pivotal structure. Alternatively, support members are used to support the pivotal structure to achieve the same purpose. However, the securing sleeves are exposed and affect the outer appearance of the bed. The use of the support members increases the number of parts used and the support members do not have satisfied features. Besides, the conventional foldable beds do not have a cover, and there is no proper design for storage of the boards. In addition, the boards are heavy and do not have apertures for ventilation. Furthermore, the conventional pivotal structure does not have sufficient functions to meet different needs such as to set a specific angle for the two frames.

The present invention intends to provide improvements for the shortcomings mentioned above.

SUMMARY OF THE INVENTION

The present invention relates to a foldable bed and comprises a first frame and a second frame. The first frame has a first board put thereon. A first connector is connected to the front end of the first frame and has a first pin hole and a first aperture which is located below the first pin hole. The second frame has a second board put thereon. A second connector is connected to the rear end of the second frame and has a second pin hole and a second aperture which is located below the first pin hole. A pivot extends through the first and second apertures to pivotably connect the first frame to the second frame. When the first and second frames are extended. A pin extends through the first and second pin holes.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
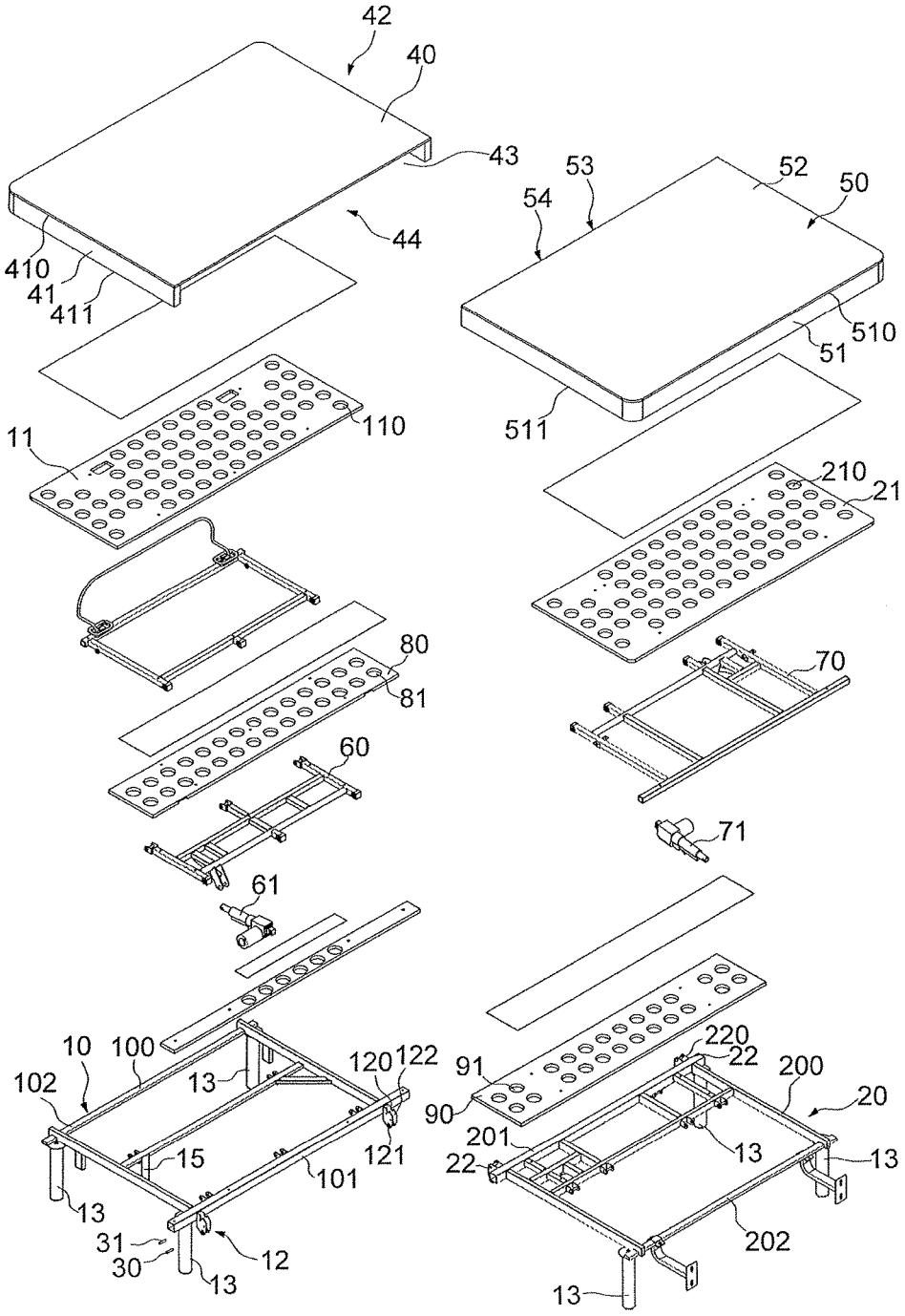
FIG. 1 is an exploded view of the foldable bed of the present invention.
Figure 2:
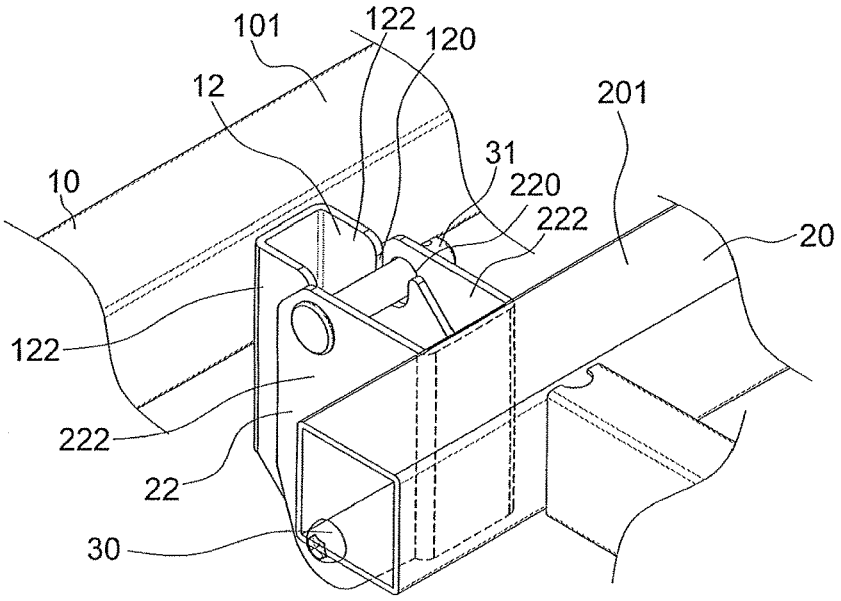
FIG. 2 is an enlarged view to show the connection of the first connector and the second connector of the foldable bed of the present invention.
Figure 3:
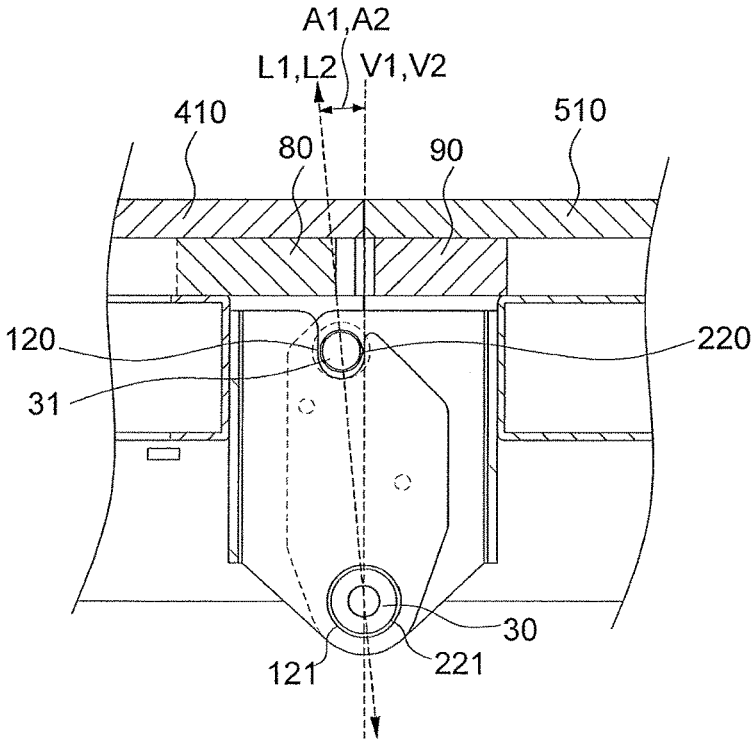
FIG. 3 shows an angle defined between the vertical line and a connection line between the first/second pin hole and the first/second aperture.
Figure 4:
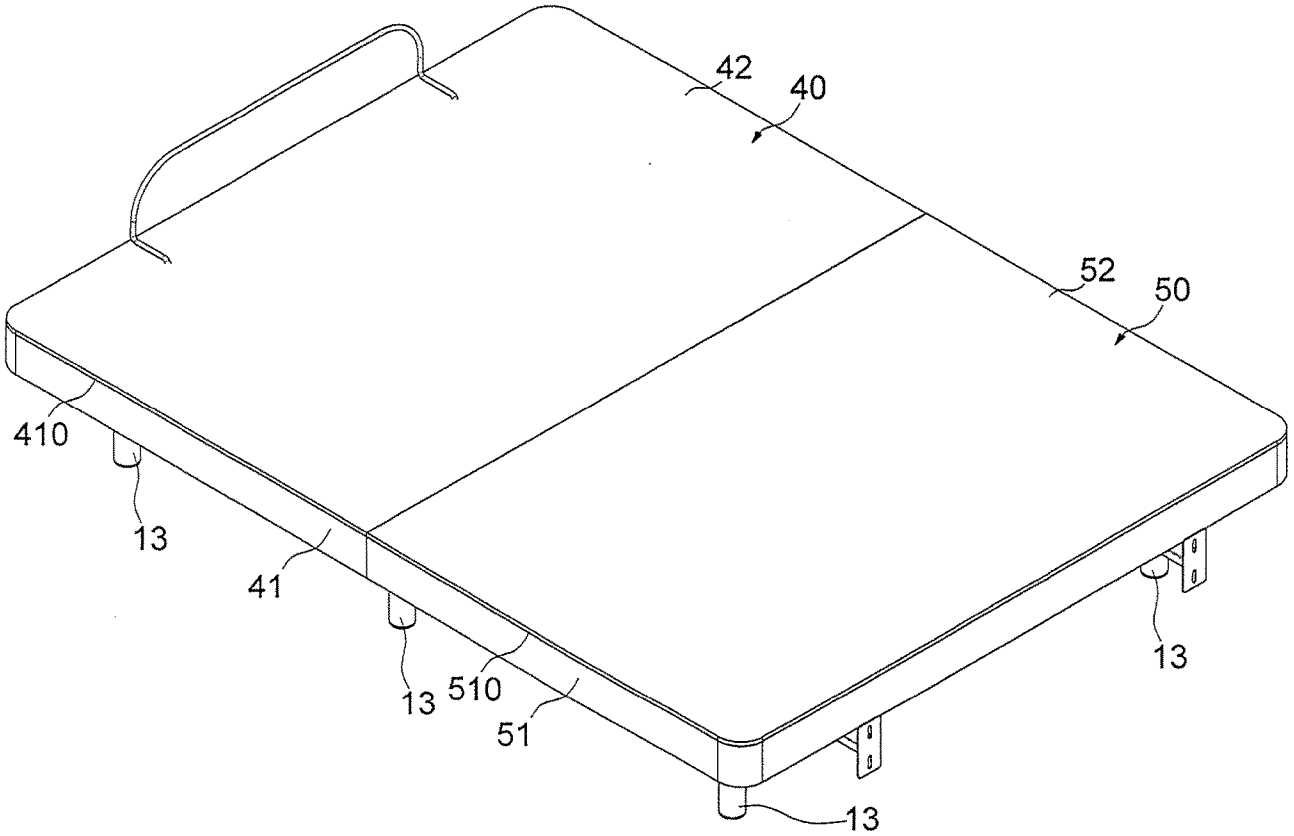
FIG. 4 shows that the foldable bed is fully extended.
Figure 5:
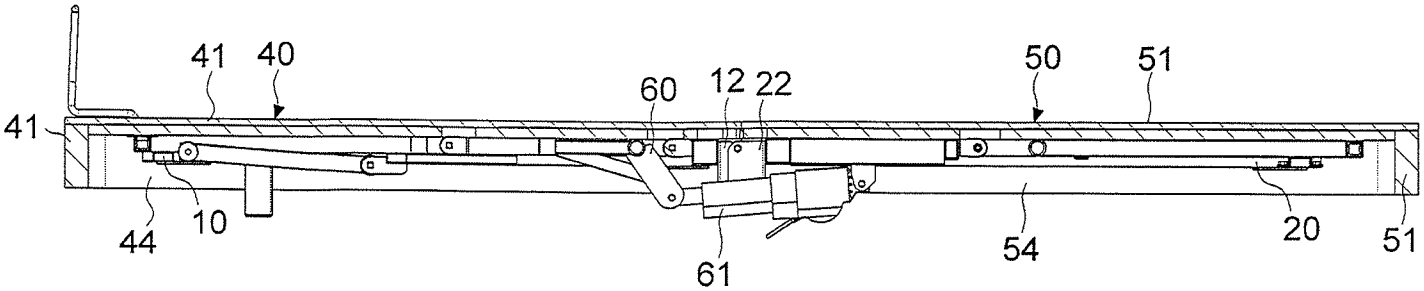
FIG. 5 is a cross sectional view to show the fully extended foldable bed.
Figure 6:
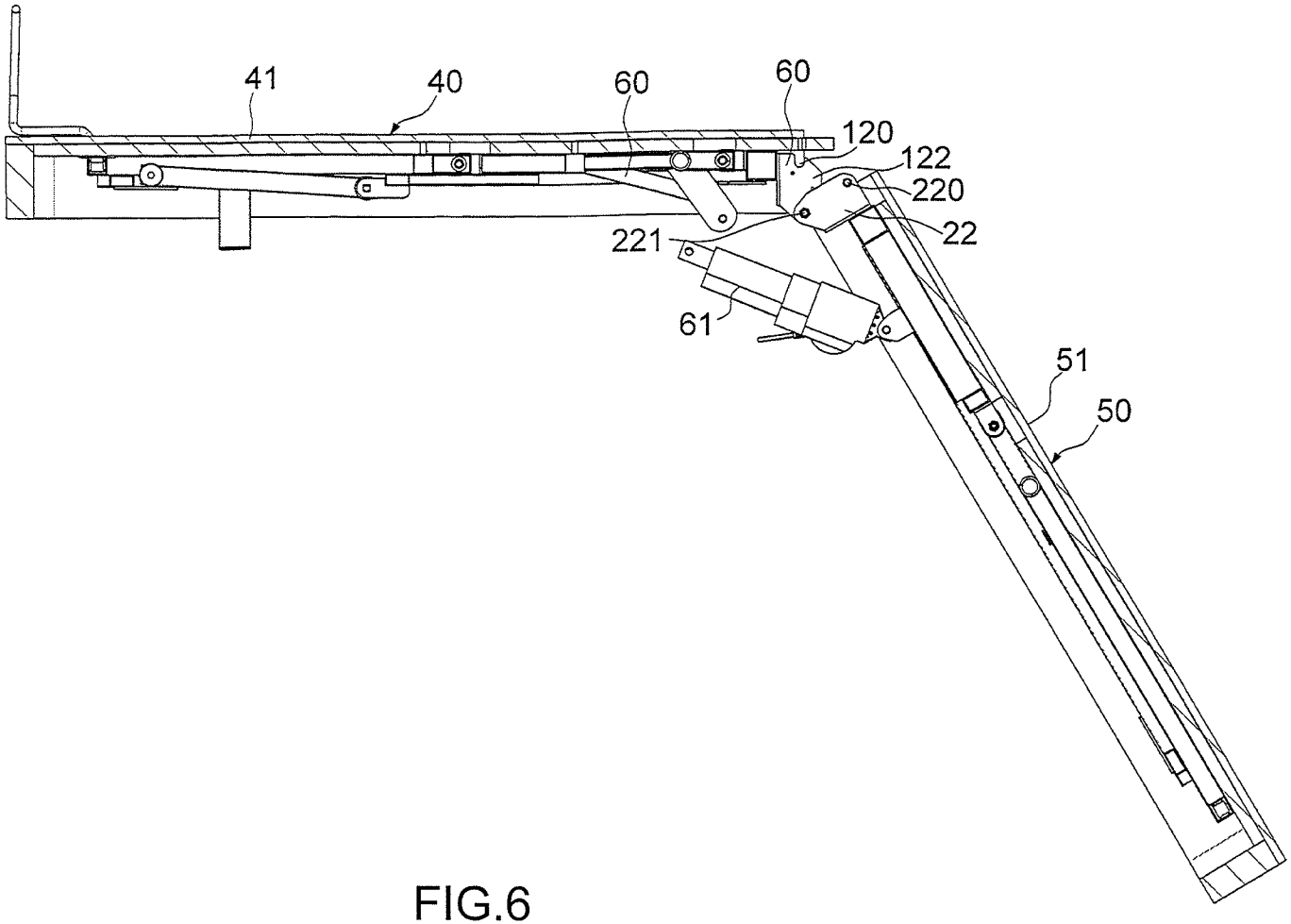
FIG. 6 is a cross sectional view to show that the first and second frames are folded an angle.
Figure 7:
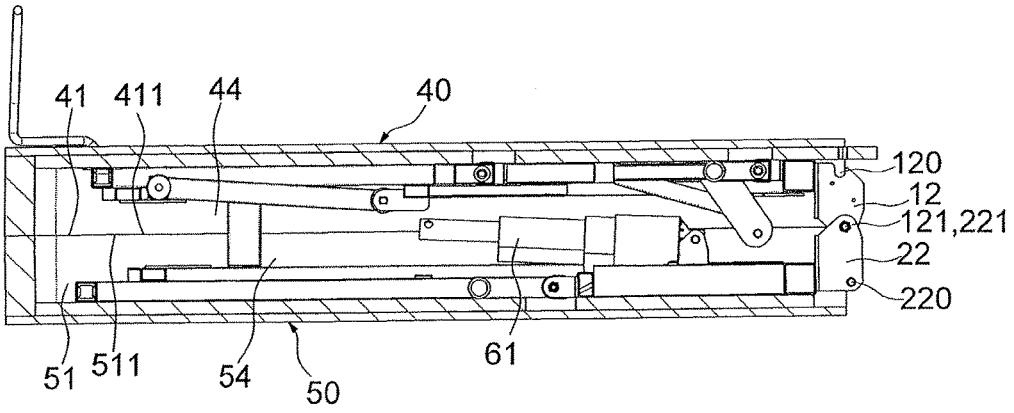
FIG. 7 is a cross sectional view to show that the foldable bed is fully folded.
Figure 8:
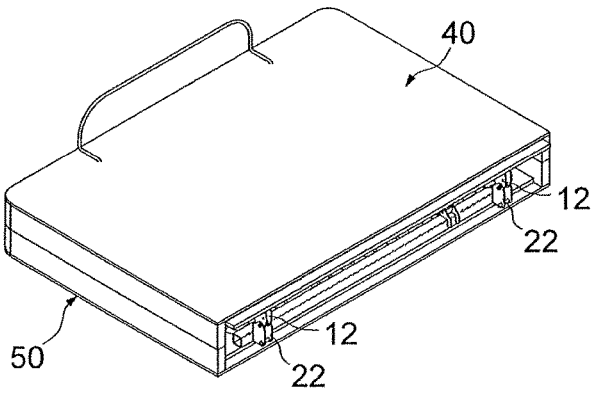
FIG. 8 is a perspective view to show that the foldable bed is fully folded.

Referring to FIGS. 1 to 5, the foldable bed of the present invention comprises a first frame 10 and a second frame 20, wherein the first frame 10 has a first board 11 connected to a top 100 thereof. At least one first connector 12 is connected to the front end 101 of the first frame 10, in this embodiment, there are two first connectors 12. Each first connector 12 has a first pin hole 120 and a first aperture 121 which is located below the first pin hole 120.

The second frame 20 has a second board 21 connected to a top 200 thereof. At least one second connector 22 is connected to the rear end of the second frame 20, in this embodiment, there are two second connectors 22. Each second connector 22 has a second pin hole 220 and a second aperture 221 which is located below the first pin hole 120. A pivot 30 extends through the first and second apertures 121, 221 to pivotably connect the first frame 10 to the second frame 20. When the first and second frames 10, 20 are pivotable about the pivot 30 and fully extended, a pin 31 extending through the first and second pin holes 120, 220.

When the first and second frames 10, 20 are set to be horizontal, the first pin hole 120 is located above the first aperture 121, an angle A1 between a connection line "L1" between two respective centers of the first pin hole 120 and the first aperture 121 and a vertical line V1 is less than 5 degrees. The second pin hole 220 is located above the second aperture 221, an angle A2 between a connection line "L2" between two respective centers of the second pin hole 220 and the second aperture 221 and the vertical line V2 is less than 5 degrees. The first connectors 12 and the second connectors 22 respectively protrude beyond the front end 101 of the first frame 10 and the rear end 201 of the second frame 20. Therefore, the first and second frames 10, 20 can be fully folded in horizontal direction for convenience of storage. The first and second frames 10, 20 each are a rectangular frame. There are two legs 13 on the rear end 102 of the first frame 10, and one leg 13 on the front end 101 of the first frame 10. The front end 202 of the second frame 20 has two legs 13, and rear end 201 of the second frame 20 has one leg 13. All of the legs 13 are able to be separated from the first and second frames 10, 20.

As shown in FIGS. 1-5, the first connectors 12 each have two first side walls 122 which are parallel to each other and connected by a bridge plate. The second connectors 22 each have two second side walls 222 which are parallel to each other and connected by a bridge plate. The first pin hole 120 and the first aperture 121 are defined through each of the two first side walls 122, and the second pin hole 220 and the second aperture 221 are defined through each of the two second side walls 222. The two first side walls 122 are located between the two second side walls 222 when the first connectors 12 are pivotably connected to the second connectors 22. In one embodiment, the first pin hole 120 is defined in the top edge of each of the first side walls 122 and in a form of a recess so that the pin 31 can easily extend through the first pin hole 120.

In order to reinforce the structural strength of the first and second connectors 12, 22, the cross section of each first connector 12 is a U-shaped cross section, and the cross section of each second connector 22 is a second U-shaped cross section. The bridge plate between the two first side walls 122 is fixed to the front end 101 of the first frame 10, and the bridge plate between the two second side walls 222 is fixed to the rear end 201 of the second frame 20.

In order to increase the ventilation feature for comfort and de-humidity reason and for reducing weight, in one embodiment, the first board 11 and the second board 21 are made by wood. The first board 11 has multiple first holes 110. The second board 21 has multiple second holes 210. The area that the first holes 110 are located occupies ⅙ to ½ of the whole area of the first board 11. The area that the second holes 210 are located occupies ⅙ to ½ of the whole area of the second board 21. Specifically, the first and second holes 110, 210 each are a circular hole, and the diameter of each of the first and second holes 110, 210 is 1.5 cm to 4.0 cm.

A first cover 40 is mounted to the first board 11 and a second cover 50 is mounted to the second board 21. The first cover 40 has a U-shaped first side panel 41 and the second cover 50 has a U-shaped second side panel 51. A first cover board 42 is connected to the top edge 410 of the first side panel 41. A first room 44 is defined between the first cover board 42 and the first side panel 41. A second cover board 52 is connected to the top edge 510 of the second side panel 51. A second room 44 is defined between the second cover board 52 and the second side panel 51. When the first board 11 and the second board 21 are folded to each other, the first bottom edge 411 of the first side panel 41 contacts the second bottom edge 511 of the second side panel 51. When the first frame 10 and the second frame 20 are respectively accommodated in the first and second rooms 44, 54, the first side panel 41 includes a first opening 43, and the second side panel 51 has a second opening 53. When the first and second boards 11, 21 are extended relative to each other, the first opening 43 is matched with the second opening 53.

The first frame 10 has a support 15 which is located between the first and second frames 10, 20 when the first and second boards 11, 21 are folded relative to each other.

In order to provide more functions to meet different needs, the first frame 10 has a first support member 60 and the second frame 20 has a second support member 70. The first support member 60 is driven by a first linear driving member 61 so as to be pivoted relative to the first frame 10. The second support member 70 is driven by a second linear driving member 71 so as to be pivoted relative to the second frame 20.

Furthermore, the first support member 60 is pivotably connected to a third support member 62. When the first support member 60 is pivoted an angle relative to the first frame 10, a pivotal portion between the first and third support members 60, 62 protrudes relative to the first frame 10. A third board 80 is connected to the first frame 10 and a fourth board 90 is connected to the second frame 20. When the first support member 60 and the second support member 70 are respectively pivoted relative to the first frame 10 and the second frame 20, the third board 80 and the fourth board 90 are respectively pivoted relative to the first and second boards 11, 21.

Again, for ventilation comfort and weight reasons, the third board 80 and the fourth board 90 are made by wood. The third board 80 has multiple third holes 81, and the fourth board 90 has multiple fourth holes 91. The area that the third holes 81 are located occupies ⅙ to ½ of the whole area of the third board 80. The area that the fourth holes 91 are located occupies ⅙ to ½ of the whole area of the fourth board 90.

While we have shown and described the embodiment in accordance with the present invention, it should be clear to those skilled in the art that further embodiments may be made without departing from the scope of the present invention.

What is claimed is:

1. A foldable bed comprising:

a first frame having a first board put thereon, at least one first connector connected to a front end of the first frame and having a first pin hole and a first aperture which is located below the first pin hole, and a second frame having a second board put thereon, at least one second connector connected to a rear end of the second frame, the at least one second connector having a second pin hole and a second aperture which is located below the first pin hole, a pivot extending through the first and second apertures to pivotably connect the first frame to the second frame, when the first and second frames are extended, a pin extending through the first and second pin holes.

2. The foldable bed as claimed in claim 1, wherein the at least one first connector has two first side walls which are parallel to each other and connected by a bridge plate, the at least one second connector has two second side walls which are parallel to each other and connected by a bridge plate, the first pin hole and the first aperture are defined through each of the two first side walls, the second pin hole and the second aperture are defined through each of the two second side walls.

3. The foldable bed as claimed in claim 2, wherein the two first side walls are located between the two second side walls when the at least one first connector is pivotably connected to the at least one second connector.

4. The foldable bed as claimed in claim 2, wherein the first pin hole is defined in a top edge of each of the first side walls and in a form of a recess.

5. The foldable bed as claimed in claim 2, wherein a cross section of the at least one first connector is a U-shaped cross section, a cross section of the at least one second connector is a second U-shaped cross section, the bridge plate between the two first side walls is fixed to the front end of the first frame, the bridge plate between the two second side walls is fixed to the rear end of the second frame.

6. The foldable bed as claimed in claim 1, wherein the first board and the second board are made by wood, the first board has multiple first holes, the second board has multiple second holes, an area that the first holes are located occupies ⅙ to ½ of an area of the first board, an area that the second holes are located occupies ⅙ to ½ of an area of the second board.

7. The foldable bed as claimed in claim 6, wherein the first and second holes each are a circular hole.

8. The foldable bed as claimed in claim 7, wherein a diameter of each of the first and second holes is 1.5 cm to 4.0 cm.

9. The foldable bed as claimed in claim 1, wherein a first cover is mounted to the first board and a second cover is mounted to the second board, the first cover has a U-shaped first side panel and the second cover has a U-shaped second side panel, a first cover board connected to a top edge of the first side panel, a first room is defined between the first cover board and the first side panel, a second cover board connected to a top edge of the second side panel, a second room is defined between the second cover board and the second side panel, when the first board and the second board are folded to each other, a first bottom edge of the first side panel contacts a second bottom edge of the second side panel, when the first frame and the second frame are respectively accommodated in the first and second rooms, the first side panel includes a first opening, the second side panel has a second opening, when the first and second boards are extended relative to each other, the first opening is matched with the second opening.

10. The foldable bed as claimed in claim 9, wherein the first frame has a support which is located between the first and second frames when the first and second boards are folded relative to each other.

11. The foldable bed as claimed in claim 1, wherein the first frame has two first connectors and the second frame has two second connectors.

12. The foldable bed as claimed in claim 1, wherein first support member is pivotably connected to a third support member, when the first support member is pivoted an angle relative to the first frame, a pivotal portion between the first and third support members protrudes relative to the first frame.

13. The foldable bed as claimed in claim 1, wherein the first frame has a first support member and the second frame has a second support member, the first support member is driven by a first linear driving member so as to be pivoted relative to the first frame, the second support member is driven by a second linear driving member so as to be pivoted relative to the second frame.

14. The foldable bed as claimed in claim 13, wherein a third board is connected to the first frame and a fourth board is connected to the second frame, when the first support member and the second support member are respectively pivoted relative to the first frame and the second frame, the third board and the fourth board are respectively pivoted relative to the first and second boards.

15. The foldable bed as claimed in claim 14, wherein the third board and the fourth board are made by wood, the third board has multiple third holes, the fourth board has multiple fourth holes, an area that the third holes are located occupies ⅙ to ½ of an area of the third board, an area that the fourth holes are located occupies ⅙ to ½ of an area of the fourth board.

16. The foldable bed as claimed in claim 1, wherein a third board is connected to the first frame, a fourth board is connected to the second frame, the third board has multiple third holes, the fourth board has multiple fourth holes, an area that the third holes are located occupies ⅙ to ½ of an area of the third board, an area that the fourth holes are located occupies ⅙ to ½ of an area of the fourth board.

17. The foldable bed as claimed in claim 1, wherein when the first and second frames are horizontally positioned, the first pin hole is located above the first aperture, an angle between a connection line between two respective centers of the first pin hole and the first aperture and a vertical line is less than 5 degrees, the second pin hole is located above the second aperture, an angle between a connection line between two respective centers of the second pin hole and the second aperture and the vertical line is less than 5 degrees.

* * * * *